US007275998B1

(12) United States Patent
Jenkins

(10) Patent No.: US 7,275,998 B1
(45) Date of Patent: Oct. 2, 2007

(54) PORTABLE COLLAPSIBLE GOLF SWING GUIDE APPARATUS

(76) Inventor: Paul D. Jenkins, 9952 Audrey Dr., Sun City, AZ (US) 85851

( * ) Notice: Subject to any disclaimer, the term of this patent is extended or adjusted under 35 U.S.C. 154(b) by 0 days.

(21) Appl. No.: 11/514,401

(22) Filed: Aug. 31, 2006

(51) Int. Cl.
*A63B 69/36* (2006.01)

(52) U.S. Cl. ..... 473/274; 473/211

(58) Field of Classification Search ..... 473/207, 473/208, 209, 211, 266, 268, 269, 271, 272, 473/273, 274, 275
See application file for complete search history.

(56) References Cited

U.S. PATENT DOCUMENTS

| | | | | | |
|---|---|---|---|---|---|
| 624,662 | A * | 5/1899 | Leedy | ..... | 248/187.1 |
| 2,031,097 | A * | 2/1936 | Bucky | ..... | 248/123.2 |
| 3,104,880 | A * | 9/1963 | Profera | ..... | 473/274 |
| 3,712,625 | A * | 1/1973 | Taylor | ..... | 473/274 |
| 4,513,972 | A * | 4/1985 | Empie | ..... | 473/274 |
| 5,439,226 | A * | 8/1995 | Luedtke | ..... | 473/232 |
| 5,577,729 | A * | 11/1996 | Sabour | ..... | 473/274 |

* cited by examiner

*Primary Examiner*—Nini F. Legesse
(74) *Attorney, Agent, or Firm*—G. F. Gallinger

(57) ABSTRACT

A golf swing apparatus comprising: a tower carrying a lateral arm having a) a lower columnar member; b) a lockable sliding collar slidingly positioned on the columnar member; c) three legs having an inner end portion hinged, and permanently attached to a bottom portion of the lower columnar member, said legs having a swinging other end portion; d) three leg braces each having a bottom end portion hingably attached to the swinging other end portion of one of the legs, the other upper end portion of the leg braces hinged to the sliding collar, so that when the sliding collar is locked in an upper storage position said legs and leg braces are generally parallel to the lower columnar member, and when the sliding collar is locked in a lower operative position the legs are maintained in a generally horizontal position to thereby contact the ground therealong; e) an inner columnar sliding member which telescopes upwardly from within the lower columnar member; f) a releasable column lock to maintain the inner columnar member in a lowered or raised position at a height selected for a particular golfer; g) the lateral arm releasably attached to and extending from a top portion of the inner columnar member, having a forehead contact portion on an extended end portion thereof; and finally, h) three ground spikes each adapted to secure one of the other outer end portions of the legs to the ground so that after the spikes attach the legs to the ground the upright column cannot be toppled without pulling the spikes from the ground. A golfer positions his forehead against the forehead contact portion to maintain his head in a generally invariant position while he is swinging his club.

11 Claims, 2 Drawing Sheets

PORTABLE COLLAPSIBLE GOLF SWING GUIDE APPARATUS

FIELD OF THE INVENTION

This invention relates to golf swing training apparatuses. More particularly this invention relates to a lightweight collapsible golf swing feedback apparatus which infolds and telescopes open from a closed carrying and storage position. When the apparatus is in the closed position it is sufficiently compact that it may be carried and stored together with the golfer's clubs.

BACKGROUND OF THE INVENTION

There are numerous golf swing improvement apparatuses. Most all of these are substantial in weight and size. Typically these apparatuses employ a head restraint which constrains, rather than guides and allows a golfer to improve his own natural swing. None can be collapsed to a size which enables them to be carried or stored with a golfer's clubs. Most all of these apparatuses have sufficient mass to require them to be mounted on a platform on which the golfer must stand; or alternatively, to be otherwise very substantially and permanently anchored to the ground. It is not presently not practically possible to bring these apparatuses to driving ranges or other practice golf areas with one's clubs.

There is a need for a lightweight, collapsible apparatus that can be carried along with golf clubs, so that the apparatus may be quickly erected on a golf course driving range or other practice area. A golf swing apparatus which is able to be collapsed and stored together with golf clubs would allow many individuals to own and utilize such an apparatus who presently are unable to do so. Such an apparatus would facilitate the development of the fundamentals of their golf swing.

OBJECTS OF THE INVENTION

It is an object of this invention to disclose a collapsible portable golf swing improvement apparatus. A golf swing training apparatus that is sufficiently small and lightweight that it can be stored and conveniently carried with a golf bag. The golf swing improvement apparatus disclosed herein employs removable stakes rather than its mass to maintain a stable position. It is an object of this invention to disclose a golf swing apparatus which guides, rather than mechanically restrains a golfer's head in his golf stroke. It is yet a further object of this invention to disclose a golf swing training apparatus which can be employed on actual driving ranges and other golf practice areas. It is a final object of this invention to provide subtle feedback to guide a golfer to position his head to gradually develop his natural swing to an improved form.

One aspect of this invention provides for a collapsible golf swing apparatus for erection on ground and turf covered ground comprising: a tower carrying a lateral arm having a) a lower columnar member; b) a lockable sliding collar slidingly positioned on the columnar member; c) three legs having an inner end portion hinged, and permanently attached to a bottom portion of the lower columnar member, said legs having a swinging other end portion; d) three leg braces each having a bottom end portion hingably attached to the swinging other end portion of one of the legs, the other upper end portion of the leg braces hinged to the sliding collar, so that when the sliding collar is locked in an upper storage position said legs and leg braces are generally parallel to the lower columnar member, and when the sliding collar is locked in a lower operative position the legs are maintained in a generally horizontal position to thereby contact the ground therealong; e) an inner columnar sliding member which telescopes upwardly from within the lower columnar member; f) a releasable column lock to maintain the inner columnar member in a lowered or raised position at a height selected for a particular golfer; g) the lateral arm releasably attached to and extending from a top portion of the inner columnar member, having a forehead contact portion on an extended end portion thereof; and finally, h) three ground spikes each adapted to secure one of the other outer end portions of the legs to the ground so that after the spikes attach the legs to the ground the upright column cannot be toppled without pulling the spikes from the ground. Wherein use a golfer positions his forehead against the forehead contact portion on the lateral arm to thereby guide him to maintain his head in a generally invariant position while he is swinging his club, but not restraining him from natural and strongly favored swinging motion.

In a preferred aspect of this invention the outer swinging end portion of each of the legs further comprises a hole therethrough to facilitate spiking the legs to the ground to substantially fortify the tower and lateral member.

Various other objects, advantages and features of this invention will become apparent to those skilled in the art from the following description in conjunction with the accompanying drawings.

FIGURES OF THE INVENTION

Figure 1:
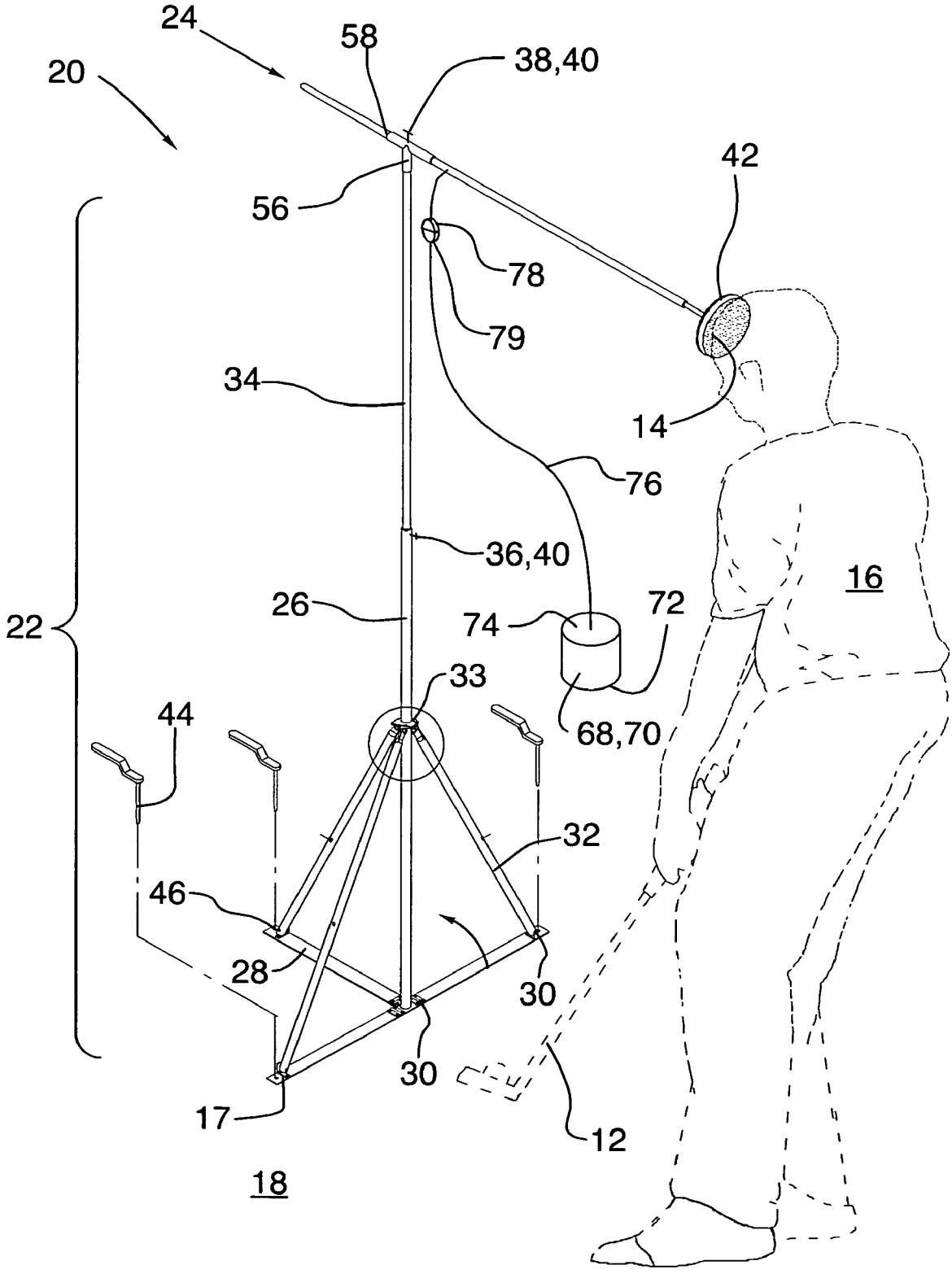
FIG. 1 is a perspective view of an erected golf swing guide apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of an erected golf swing guide apparatus 20. Most generally a collapsible golf swing apparatus 20 for erection on ground 18 and turf covered ground 18 comprises: a tower 22 carrying a lateral arm 24 having a) a lower columnar member 26; b) a lockable sliding collar 33 slidingly positioned on the columnar member 26; c) three legs 28 each having an inner end portion hinged, and permanently attached to a bottom portion of the lower columnar member 26, said legs 28 having a swinging other end portion; d) three leg braces 32 each having a bottom end portion hingably attached to the swinging other end portion of one of the legs 28, the other upper end portion of the leg braces 32 hinged to the sliding collar 33. When the sliding collar 33 is locked in an upper storage position said legs 28 and leg braces 32 are generally parallel to the lower columnar member 26, and when the sliding collar 33 is locked in a lower operative position the legs 28 are maintained in a generally horizontal position to thereby contact the ground therealong; e) an inner columnar sliding member 34 which telescopes upwardly from within the lower columnar member 26; f) a releasable column lock 36 to maintain the inner columnar member 34 in a lowered or raised position at a height selected for a particular golfer 16; g) the lateral arm 24 releasably attached to and extending from a top portion of the inner columnar member 34, having a forehead contact portion 42 on an extended end portion thereof; and finally, h) three ground spikes 44 each adapted to secure one of the other outer end portions of the legs 28 to the ground 18 so that after the spikes 44 attach the legs 28 to the ground 18, the tower 22 cannot be toppled without pulling the spikes 44 from the ground 18. If it is desired to use the apparatus 20 on a hard surface then ballasts (not shown) can be substituted for the spikes 44. Wherein use a golfer 16 positions his forehead 14 against the forehead contact portion 42 on the lateral arm 24 to thereby guide him to maintain his forehead 14 in a generally invariant position while he is swinging his club 12, but not restraining him from his natural and strongly favored swinging motion.

Most preferably the apparatus 20 further comprises holes 17 in the outer swinging end portion of each of the legs 28 to facilitate spiking the legs 28 to the ground 18 to thereby substantially fortify the tower 22 and lateral member 24. Most preferably one of the legs 28 extends from the columnar member 26 in a direction opposite to the extension of the lateral arm 24 therefrom, and wherein the other two lateral legs 28 extend outwardly in directions generally perpendicular to that one of the legs 28 which extends in a direction opposite to the extension of the lateral arm 24.

Figure 2:
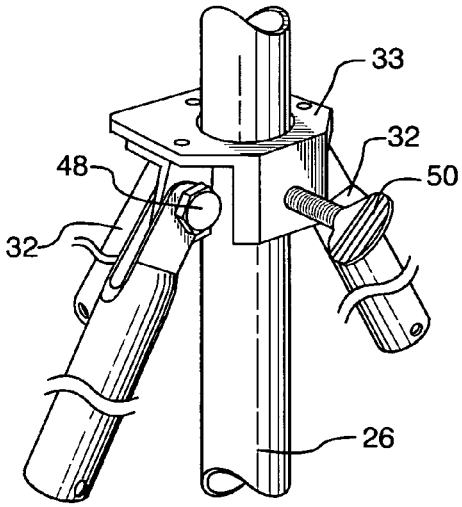
FIG. 2 is an enlarged perspective view of the leg braces where hinged to the sliding collar on the columnar member.
Figure 3:
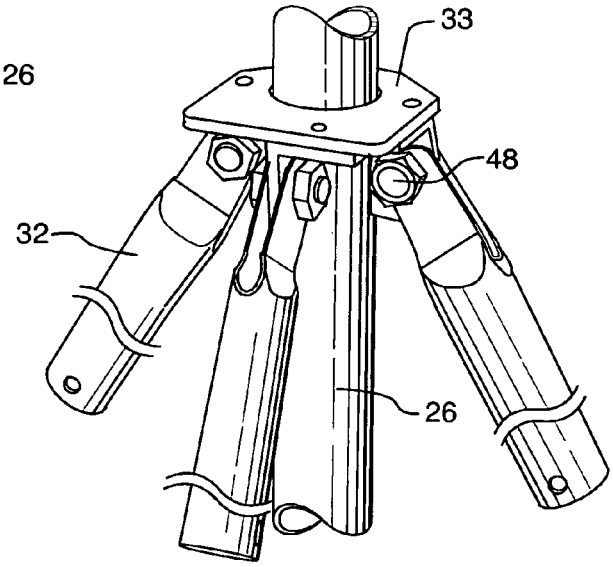
FIG. 3 is an enlarged perspective rear view of the leg braces where hinged to the sliding collar on the columnar member.

FIG. 2 is an enlarged perspective view of the leg braces 32 where hinged to a locking collar 33 which slides on columnar member 26. FIG. 3 is an enlarged perspective rear view of the leg braces where hinged to the sliding collar on the columnar member. In this preferred embodiment of the invention the leg braces 32 are hingably attached to the locking collar 33 with bolts 48. A thumb screw 50 lockably secures the sliding collar 33 to the columnar member 26. FIG. 1 shows the leg braces 32 in an operative position. To move the leg braces 32 to a storage position thumb screw 50 is loosened and locking collar 33 is slid upwardly swinging legs 28 upwardly until both the legs 28 and the leg braces 32 are in a position parallel and in close proximity to said columnar member 26. To maintain this storage position thumb screw 50 is tightened.

In the most preferred embodiment of the invention an upper portion of the upper columnar member 26 comprises a tee 56 (shown in FIG. 1) having a lateral opening 58 therethrough to slidably receive the lateral arm 24. A releasable lock means 38 is provided to releasably position the lateral arm 24 therein the tee 56. In the most preferred embodiment of the invention the releasable lock means 38 to secure the lateral arm 24 within the tee 56, and the releasable column lock 36 to secure the inner columnar member 34 within the lower columnar member 26, comprises a finger nut screw 40. Most preferably the columnar members 26, 34, the braces 32, and the lateral arm 25 comprise tubing.

Figure 4:
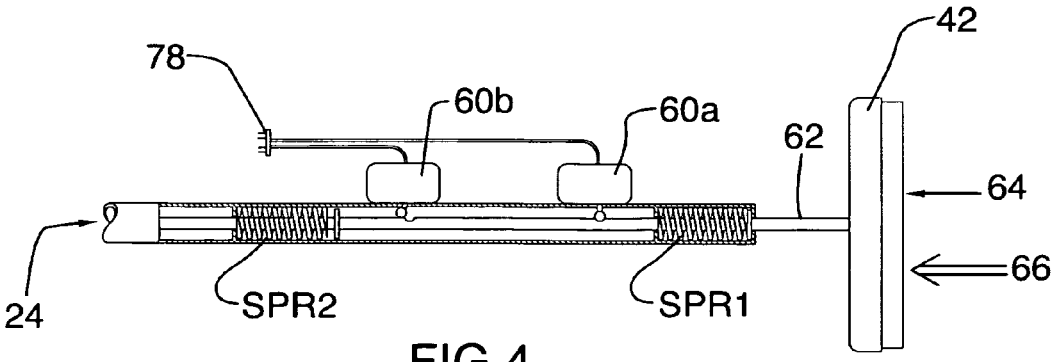
FIG. 4 is an enlarged cross sectional view of bitone switches in the lateral arm.

FIG. 4 is an enlarged cross sectional view of the bitone switches 60*a*, 60*b* carried by the lateral arm 24. As shown in FIG. 3 the forehead contact member 42 is carried by a shaft 62 which is connected to a first switch 60*a* which is biased to a closed position, but will open when minimal longitudinal lateral pressure 64 is exerted by a golfer 16 on the forehead portion 42, so that when the golfer 16 moves his forehead 14 away from the forehead contact portion 42, the first toggle switch 60*a* will close; SPR1 maintains 60*a* in a normally closed position. Shaft 62 is connected to a second toggle switch 60*b* which is biased to an open position by spring SPR2, said second switch 60*b* is configured to close when more substantial longitudinal lateral force 66 is applied by the golfer 16 on the forehead contact portion 42. The switches 60*a*, 60*b* are connected to an audible signal generator 68 which will sound when either switch 60*a*, 60*b* is closed. In the most preferred embodiment the audible signal 68 is a bitone generator 70 and a low pitch is emitted when contact is broken with the forehead contact portion 42, and a higher pitch is emitted when excessive moving force 66 is applied to the contact portion 42. The golfer 16 will thereby know when his forehead 14 is shifted back from, or excessively towards the forehead contact portion 42 of the lateral arm 24. In the most preferred embodiment of the invention the bitone generator 70 is maintained in a canister 72 together with a battery pack 74, all of which are connected with a wire 76 having a plug 78 and receptacle 79 so that the canister can be disconnected from the switches 60*a*, 60*b* carried by the lateral arm 24 when the tower 22 is collapsed.

While the invention has been described with preferred specific embodiments thereof, it will be understood that this description is intended to illustrate and not to limit the scope of the invention, which is defined by the following claims.

I claim:

1. A collapsible golf swing apparatus for erection on ground and turf covered ground comprising:

a tower carrying a lateral arm having a) a lower columnar member;

b) a lockable sliding collar slidingly positioned on an upper portion of the columnar member;

c) three legs having an inner end portion hinged, and permanently attached beneath the sliding collar to a bottom portion of the lower columnar member, said legs having a swinging other end portion;

d) three leg braces each having a bottom end portion hingably attached to the swinging other end portion [of one] of the legs, the other upper end portion of the leg braces hinged to the sliding collar, so that when the sliding collar is locked in an upper storage position said legs and leg braces are generally parallel to the lower columnar member, and when the sliding collar is locked in a lower operative position the legs are maintained in a generally horizontal position to thereby contact the ground therealong;

e) an inner columnar sliding member which telescopes upwardly from within the lower columnar member;

f) a releasable column lock to maintain the inner columnar member in a lowered or raised position at a height selected for a particular golfer;

g) the lateral arm releasably attached to and extending from a top portion of the inner columnar member, having a forehead contact portion on an extended end portion thereof; and finally, h) three detached ground spikes each adapted to secure one of the other outer end portions of the legs to the ground so that after the spikes attach the legs to the ground the upright column cannot be toppled without pulling the spikes from the ground;

wherein use a golfer seats the columnar member on the ground and then slides down the sliding collar until it will slide no further when the swinging other end portion of the legs contacts the ground, positions his forehead against the forehead contact portion on the lateral arm to thereby guide him to maintain his head in a generally invariant position while he is swinging his club, but not restraining him from natural and strongly favored swinging motion.

2. An apparatus as in claim 1 wherein the outer swinging end portion of each of the legs further comprises a hole therethrough to facilitate spiking the legs to the ground to substantially fortify the tower and lateral member.

3. An apparatus as in claim 2 wherein one of the legs extends from the columnar member in a direction opposite to the extension of the lateral arm therefrom, and wherein the other two lateral legs extend outwardly in a direction generally perpendicular to that one of the legs.

4. An apparatus as in claim 2 wherein the braces are hingably attached to the sliding collar with a bolt.

5. An apparatus as in claim 4 wherein the sliding collar is lockably secured on the lower columnar member with a thumb screw.

6. An apparatus as in claim 4 wherein the releasable lock means to secure the lateral arm within the tee and wherein the releasable column lock to secure the inner columnar member within the lower columnar member comprises a finger nut screw.

7. An apparatus as in claim 1 wherein an upper portion of the upper columnar member comprises a tee having a lateral opening therethrough to slidably receive the lateral arm and further comprising a releasable lock means to releasably position the lateral arm therein.

8. An apparatus as in claim 1 wherein the columnar members, braces and lateral arm comprise tubing.

9. An apparatus as in claim 1 wherein the forehead contact member is carried by a shaft which is connected to a first switch which is biased to a closed position, but will open when minimal longitudinal lateral pressure is exerted by a golfer on the forehead contact portion, so that when the golfer moves his head away from the forehead contact portion, the first switch will close; and wherein the shaft is connected to a second switch which is biased to an open position, said second switch configured to close when more substantial longitudinal lateral force is applied by the golfer on the forehead contact portion; and wherein both of the switches are connected to an audible signal generator which will sound when either switch is closed.

10. An apparatus as in claim 9 wherein the audible signal generator is a bitone generator and wherein a low pitch is emitted when contact is broken from the forehead contact portion and wherein a higher pitch is emitted when excessive moving force is applied to the contact portion so that the golfer will know when his forehead is shifted back from, or excessively towards the forehead contact portion of the lateral arm.

11. An apparatus as in claim 10 wherein the bitone generator is maintained in a canister together with a battery pack, all of which are connected with a wire having a plug and receptacle therein to the switches carried by the lateral arm.

* * * * *